United States Patent [19]
Cline et al.
[11] 4,231,377
[45] Nov. 4, 1980

[54] WRAPPER FOR SMOKING ARTICLES CONTAINING MAGNESIUM OXIDE

[75] Inventors: Warren K. Cline, Brevard; Richard H. Martin, Pisgah Forest, both of N.C.

[73] Assignee: Olin Corporation, Pisgah Forest, N.C.

[21] Appl. No.: 937,936

[22] Filed: Aug. 30, 1978

[51] Int. Cl.[3] ..... A24B 15/28; A24D 1/02
[52] U.S. Cl. ..... 131/9; 131/15 R
[58] Field of Search ..... 131/8 R, 2, 9, 15 R, 131/15 C, 140 C, 17

[56] References Cited

U.S. PATENT DOCUMENTS

| | | | |
|---|---|---|---|
| 2,029,494 | 2/1936 | Loewenthal | 131/17 R |
| 3,744,496 | 6/1973 | McCarty et al | 131/8 |
| 4,008,723 | 2/1977 | Borthwick et al | 131/2 |

OTHER PUBLICATIONS

*Tobacco and Tobacco Smoke* by Wynder et al., Academic Press 1967, p. 601.

*Primary Examiner*—V. Millin
*Attorney, Agent, or Firm*—Robert W. Habel

[57] ABSTRACT

A wrapper for smoking articles such as cigarettes, cigars and the like containing at least 15% by weight magnesium oxide or its hydrate and at least 0.5% by weight of a specific chemical adjuvant such as the alkali metal acetates, carbonates, citrates, nitrates or tartrates. The combination of magnesium oxide or its hydrate with any of the chemical adjuvants significantly reduces visible sidestream smoke that emanates during static burning from smoking articles employing the wrapper. The wrapper may comprise conventional cigarette paper with magnesium oxide and the adjuvant incorporated therein as the filler in the paper furnish or either or both of the additives may be applied to the paper as a coating. Wrappers containing the additives can be used in place of conventional wrappers for smoking articles or used as an inner wrapper for the tobacco column in combination with a conventional outer wrapping of cigarette paper or cigar wrap.

20 Claims, No Drawings

WRAPPER FOR SMOKING ARTICLES CONTAINING MAGNESIUM OXIDE

BACKGROUND OF THE INVENTION

1. Field of the Invention

This invention relates generally to smoking articles such as cigarettes, cigars and the like and the wrapper for the tobacco column thereof, and more particularly to an improved wrapper for such smoking articles for use either by itself or as an inner wrapper in combination with a conventional outer wrapper which significantly reduces the amount of visible sidestream smoke that normally emanates from a smoking article during static burning.

2. Prior Art

One of the common problems associated with smoking articles such as cigarettes or cigars is the amount of sidestream smoke that is given off during static burning, for example when the smoking article is idling and not being drawn upon by the smoker or is simply resting in an ashtray while burning. Visible sidestream smoke that is given off by a smoking article such as a cigarette during static burning is comprised mainly of particulate matter and the smoke is irritating and objectionable to nonsmokers in the vicinity of the idling cigarette. Various mechanisms have been incorporated into smoking articles to reduce visible sidestream smoke but none to date has been commercially successful in cigarettes. Probably the most effective means of reducing visible sidestream smoke is disclosed in U.S. Pat. No. 3,744,496 in which a smoking article such as a cigarette is designed to include an inner wrapper around the tobacco charge containing finely pulverized carbon particles in combination with a conventional outer wrapper of cigarette paper. However, due to the carbon employed in such wrappers they have not found widespread use in cigarettes primarily because of the objectionable dark color imparted to the wrapper from the carbon. Their success has mostly been in the cigar field where the darker wrap is less noticeable and therefore not objectionable. In any case, carbon filled wrappers have proved to be very successful in reducing sidestream smoke emanating from a smoking article during static burning.

Conventional cigarette paper normally contains a filler of calcium carbonate to improve the appearance and properties of the paper. In addition, various burning chemicals may also be added to the paper furnish to improve the burn rate and ash characteristics of cigarettes made therefrom. Cigarette papers containing such materials are disclosed in U.S. Pat. Nos. 2,580,611, 2,652,834, and 2,733,720. None of the additives used in such conventional cigarette papers have a significant effect upon reduction of undesirable constituents in the cigarette smoke or effectively reduce visible sidestream smoke. It is also known to coat cigarette papers with a thin layer of metal such as aluminum or aluminum-base alloys to increase the burning temperature of the smoking article as disclosed in U.S. Pat. No. 3,586,005. Such metal coated cigarette papers have little effect upon reducing visible sidestream smoke. U.S. Pat. No. 2,673,799 discloses a method for improving the ashing properties of cigarette paper when burned as a wrapper on a cigarette by incorporating small amounts of magnesium carbonate in cigarette paper. The amount of magnesium carbonate employed in such papers preferably falls within the range of approximately 0.5 to 2.0% based on the weight of the filler. While papers produced in this manner do have improved ashing properties, they do not reduce visible sidestream smoke.

SUMMARY OF THE INVENTION

It is therefore an object of this invention to provide a means for reducing the visible sidestream smoke emanating from smoking articles during the static burning, in particular means for reducing the total particulate matter in the sidestream smoke. Another object is to provide a means for reducing the visible sidestream smoke without impairing the smoking characteristics of the smoking article. A more specific object is to provide a unique and novel wrapper for the tobacco column of cigarettes, cigars and the like which accomplishes the foregoing objects.

In accordance with this invention, a wrapper is provided for smoking articles such as cigarettes, cigars and the like having incorporated therein at least 15% by weight magnesium oxide in combination with at least 0.5% by weight of a specific chemical adjuvant selected from the group consisting of alkali metal acetates, carbonates, citrates, nitrates or tartrates whereby the combination acts to significantly reduce visible sidestream smoke emanating from the smoking article during static burning. As used herein, magnesium oxide includes its hydrate, magnesium hydroxide, and mixtures of magnesium oxide and magnesium hydroxide. Particularly preferred as the chemical adjuvant in the combination are sodium or potassium acetate or carbonate. Wrappers made according to this invention may be made by incorporating the magnesium oxide and chemical adjuvant as a filler in the wrapper pulp furnish or either or both of the additives may be applied to the wrapper as a coating. In the case of cigarette papers, they may be made using an ordinary paper furnish such as pulped wood or flax fibers to which is added a sufficient quantity of magnesium oxide filler. The magnesium oxide may be used as the sole filler for the paper or it may be used in combination with other conventional fillers such as calcium carbonate provided at least 15% by weight of the wrapper is magnesium oxide. The furnish of fiber pulp and magnesium oxide filler is then used to make a paper sheet on conventional papermaking machines. The alkali metal salt chemical adjuvant preferably is applied to the finished paper at the size press on the paper machine or as a separate treating operation after the paper is produced. Likewise, instead of using the magnesium oxide in the furnish as a filler, it may be applied to the finished paper as a coating using rotogravure or other conventional coating techniques after the paper is made. The particular fiber furnish from which the wrappers are made is not critical and any of the cellulosic fiber pulps used in papermaking can be employed. The fiber pulps customarily used to make paper wrappers for cigarettes or the tobacco materials used to make cigar wrap are preferred. Thus, in addition to wood and flax fibers, the furnish may be pulped tobacco stalks or stems to which is added the magnesium oxide or the magnesium oxide may be used in the furnish used in making reconstituted tobacco sheets for cigar wrap and the chemical adjuvant salt impregnated in the material after production.

Neither magnesium oxide nor the chemical adjuvant salts when used alone as a filler or coating in smoking article wrappers substantially reduce visible sidestream smoke. Surprisingly, however, it was found that when a small amount of the chemical adjuvant salt is used in combination with magnesium oxide, they act to substantially and significantly reduce visible sidestream smoke. The amounts of magnesium oxide and chemical adjuvant employed in the wrapper are critical and it has been found that amounts of magnesium oxide less than 15% and of chemical adjuvant salt of less than 0.5% by weight are ineffective in combination to achieve the desired reduction in visible sidestream smoke. It was also found that only certain salts, namely the alkali metal acetates, carbonates, citrates, nitrates and tartrates, are significantly effective in combination with magnesium oxide to reduce visible sidestream smoke. Various mixtures of the chemical adjuvant may also be used such as sodium or potassium citrate mixed with sodium or potassium carbonate. Preferably and for maximum sidestream smoke reductions, the wrapper should contain at least 35% magnesium oxide and at least 2.0% of the chemical adjuvant salt, both percentages by weight based on the weight of the wrapper.

Smoking article wrappers containing magnesium oxide and the chemical adjuvant salt according to this invention may be used as an inner wrapper under a normal outer wrapper for the tobacco column of the cigarette or cigar. Conventional cigarette paper, and preferably very porous or perforated cigarette paper, or cigar wrap is then used as the outer wrapping for the smoking article. Such a combination reduces the tobacco weight necessary to make a satisfactory product, increases the tobacco rod firmness, and does not alter the appearance of the cigarette or cigar. Wrappers containing the additives according to this invention also may be used as the single wrap for a smoking article. With cigarettes, it is especially desirable to use high basis weight papers if only a single wrap is employed. Both of the additives are essentially white and therefore do not alter the appearance of the cigarette paper, which is especially important.

Reductions of at least 20% sidestream particulate matter yields are obtained in smoking articles in which wrappers according to this invention are employed and reductions of 50% or more can be achieved, depending upon the combination of magnesium oxide and chemical adjuvant salt employed in the wrapper.

PREFERRED EMBODIMENTS

Typical results demonstrating the effects obtained in accordance with this invention are described in the following examples which are illustrative of the invention only and not in limitation thereof.

EXAMPLE I

Double Wrap Cigarettes with Magnesium Oxide Coated Inner Wrap

A superporous cigarette paper wrapper made from a mixture of wood pulp and hemp fibers was gravure coated using an aqueous coating mixture which contained 40% magnesium oxide and 4% ethyl cellulose. The coated papers were used as inner wraps in double wrap cigarettes. The outer wrapper used in all the cigarette samples was a calcium carbonate filled flax cigarette paper. The cigarettes were tipped with a cellulose acetate tow filter. The same weight, within ±5 milligrams, of tobacco from the same brand of commercial cigarettes was used in all cases. The range of magnesium oxide coating weights indicated in Table I was achieved in part by diluting the coating mixture and in part by using coarser or finer overall engraved rolls. Some of the inner wrap base papers were pretreated on a size press with solutions containing sodium and potassium citrates in a weight ratio of 2.4 to 1 to give the indicated levels of citrate based on the weight of the paper. The controls all had uncoated inner wraps with or without added citrates.

Sidestream smoke particulates were determined using a device made from an inverted wide mouth glass jar with the bottom cut out. The open upper end was covered with a piece of Cambridge filter material cut to fit the opening. The filter was held in place by an inverted funnel. The funnel was secured and an essentially airtight seal provided by a clamping device that also supported the jar above the bench top. The open end of the funnel was connected to a mechanical pump which provided sufficient vacuum to insure an appropriate upward flow of air through the filter. Cigarettes were mounted on an appropriately bent piece of stiff wire by inserting one end of the wire into the cigarette filter. The cigarette was then lit and immediately placed in the jar, held in place by the wire. Smoke from 55 millimeters each of three smouldering cigarettes was collected in this fashion. The sidestream particulate yield in milligrams per cigarette was calculated from the weight gain of the piece of filter material. All percentages are by weight based on the weight of the wrapper.

Sidestream particulate yields for the various tests and control cigarettes are recorded in Table I.

TABLE I

Reduction in Sidestream Smoke Particulates by Magnesium Oxide Coated Inner Wrap in Double Wrap Cigarettes

| | Inner Wrap | | Sidestream Particulate |
|---|---|---|---|
| | MgO Coating, % | Na & K Citrates, % | (mg/cigarette) |
| Control | 0.0 | 0.0 | 22.1 |
| | 0.0 | 0.5 | 19.1 |
| | 26.6 | 0.0 | 18.8 |
| | 26.6 | 0.5 | 15.7 |
| | 33.4 | 0.5 | 14.5 |
| | 40.0 | 0.5 | 15.3 |
| | 0.0 | 1.5 | 17.6 |
| | 40.0 | 1.5 | 15.6 |
| | 0.0 | 2.3 | 18.3 |
| | 49.0 | 2.3 | 13.2 |

EXAMPLE II

Single Wrap Cigarettes with Magnesium Oxide Coated Wrappers

This example shows sidestream smoke solids yields for single wrap cigarettes with magnesium oxide coatings with and without citrates in the base paper compared with appropriate control samples. Except for the citrate content, the same grade $CaCO_3$ filled flax cigarette paper with a Greiner porosity of 8 seconds per 50 cc was used throughout. The coatings were applied as in the case of the inner wraps of Example I. Coatings were applied to the wire side of the paper and this side was rolled inside next to the tobacco in the test cigarettes. The same type and quantity of tobacco and smoking test method was used as in Example I. All percentages are by weight based on the weight of the paper.

TABLE II

Effect of Using Magnesium Oxide Coated Wrappers on the Yield of Sidestream Smoke Particulates

| Cigarette Wrapper | | Sidestream Particulates |
|---|---|---|
| MgO Coating, % | Na & K Citrates, % | (mg/cigarette) |
| Control 0 | 0.0 | 29.5 |
| 0 | 0.8 | 24.7 |
| 32 | 0.8 | 20.8 |
| 37 | 0.8 | 19.0 |
| 16 | 0.0 | 26.9 |
| 0 | 3.65 | 19.0 |
| 16 | 3.65 | 18.7 |
| 37 | 3.65 | 18.0 |

EXAMPLE III

Single Wrap Cigarettes with Magnesium Oxide Filled Wrappers

Cigarettes wrapped in paper filled with magnesium oxide were compared with cigarettes wrapped in similar calcium carbonate filled paper. The papers used were handsheets all made from the same flax furnish. Where the presence of citrate or sodium carbonate is indicated, it was added by passing pieces of the paper through a solution of the indicated concentration at the nip of the laboratory size press to yield a comparable percentage by weight based on the weight of the paper. Tobacco type and quantity and cigarette construction were the same as in Example II. The test method of Example I was used.

TABLE III

Comparison of Sidestream Smoke Particulate Yields from Cigarettes Wrapped in Magnesium Oxide and $CaCO_3$ Filled Papers

| Filler | | Basis Wt. | Chemical Adjuvant | | Sidestream Particulates |
|---|---|---|---|---|---|
| Type | % | ($g/m^2$) | % Solution | Type | (mg/cigarette) |
| $CaCO_3$ | 35 | 50 | 0.0 | — | 22.2 |
| MgO | 35 | 50 | 0.0 | — | 18.4 |
| $CaCO_3$ | 35 | 50 | 1.0 | Na & K Citrate | 16.9 |
| MgO | 35 | 50 | 1.0 | Na & K Citrate | 14.5 |
| $CaCO_3$ | 50 | 50 | 0.0 | — | 23.7 |
| MgO | 50 | 50 | 0.0 | — | 16.4 |
| $CaCO_3$ | 50 | 50 | 1.0 | Na & K Citrate | 17.3 |
| MgO | 50 | 50 | 1.0 | Na & K Citrate | 13.1 |
| $CaCO_3$ | 35 | 23 | 0.0 | — | 31.8 |
| MgO | 35 | 23 | 0.0 | — | 22.4 |
| $CaCO_3$ | 35 | 23 | 2.0 | $Na_2CO_3$ | 24.3 |
| MgO | 35 | 23 | 2.0 | $Na_2CO_3$ | 16.7 |

EXAMPLE IV

The effectiveness of sodium carbonate, potassium carbonate and a mixture of sodium and potassium citrates was compared by treating superporous cigarette paper with solutions of these salts at the indicated concentration, coating with magnesium oxide and using the coated paper as inner wrap in double wrapped cigarettes. Coating weights of the magnesium oxide were 38 to 43% of the total weight of the inner wrap. Except for the use of the different salts, materials and the test method were the same as those described in Example I. The sidestream particulate yields presented in Table IV indicate that sodium and potassium carbonate are about as effective as citrates.

TABLE IV

Sidestream Smoke Yields from Double Wrap Cigarettes

| Chemical Adjuvant | | Sidestream Particulate Yield |
|---|---|---|
| Type | % Solution | (mg/cigarette) |
| Na & K Citrates | 3.4 | 13.5 |
| $Na_2CO_3$ | 2.0 | 13.7 |
| $K_2CO_3$ | 2.0 | 14.4 |

EXAMPLE V

In addition to the same three chemical adjuvants used in Example IV, sodium acetate and potassium nitrate were evaluated with magnesium oxide filled cigarette paper. Handsheets like those used in the experiments reported in Example III were treated with each of these salts. Results of sidestream particulate determinations on cigarettes wrapped in the treated papers are recorded in Table V. Sodium carbonate and sodium acetate are most effective and about equal in reducing sidestream smoke. Potassium nitrate, potassium carbonate and the sodium or potassium citrates, while not quite as effective, also substantially reduce sidestream smoke particulate yields when used in combination with the magnesium oxide filler.

TABLE V

Comparison of Sidestream Smoke Particulate Yields from Cigarettes Wrapped in Magnesium Oxide and $CaCO_3$ Filled Papers (Basis Weight, 50 $g/m^2$)

| Filler | | Chemical Adjuvant | | Sidestream Particulates |
|---|---|---|---|---|
| Type | % | Type | % Solution | (mg/cigarette) |
| $CaCO_3$ | 35 | Citrate | 3.5 | 17.6 |
| MgO | 35 | Citrate | 3.5 | 14.0 |
| $CaCO_3$ | 50 | Citrate | 3.5 | 16.6 |
| MgO | 50 | Citrate | 3.5 | 13.3 |
| $CaCO_3$ | 35 | $Na_2CO_3$ | 2.0 | 15.7 |
| MgO | 35 | $Na_2CO_3$ | 2.0 | 10.9 |
| $CaCO_3$ | 50 | $Na_2CO_3$ | 2.0 | 15.8 |
| MgO | 50 | $Na_2CO_3$ | 2.0 | 12.2, 11.5 |
| MgO | 35 | $Na_2CO_3$ | 3.5 | 12.4 |
| MgO | 50 | $Na_2CO_3$ | 3.5 | 10.8 |
| MgO | 35 | $K_2CO_3$ | 3.5 | 12.8 |
| MgO | 50 | $K_2CO_3$ | 3.5 | 11.4 |
| MgO | 50 | Na Acetate | 3.5 | 8.9 |
| MgO | 50 | K $NO_3$ | 3.5 | 12.1 |

The effectiveness of the magnesium oxide and alkali metal acetates, carbonates, citrates or nitrates containing wrappers for smoking articles such as cigarettes and cigars according to this invention is quite apparent from the foregoing illustrative examples. Many variations will become apparent to those skilled in the art and the invention is not limited to the preferred embodiments shown. Various modifications and changes may be made without departing from the spirit and scope of the invention as defined in the following claims:

What is claimed is:

1. A wrapper for the tobacco charge in a smoking article comprising a combustible cellulosic sheet containing at least 15% magnesium oxide and at least 0.5% of a chemical adjuvant salt selected from the group consisting of the alkali metal acetates, carbonates, citrates, nitrates and tartrates, both percentages by weight based upon the weight of the wrapper.

2. The wrapper of claim 1 in which the cellulosic sheet is cigarette paper.

3. The wrapper of claim 1 in which the cellulosic sheet is cigar wrap.

4. The wrapper of claim 1 in which the salt is sodium or potassium acetate.

5. The wrapper of claim 1 in which the salt is sodium or potassium carbonate.

6. The wrapper of claim 1 in which the salt is sodium or potassium citrate.

7. The wrapper of claim 1 in which the salt is sodium or potassium nitrate.

8. The wrapper of claim 1 in which the salt is sodium or potassium tartrate.

9. The wrapper of claim 1 in which the cellulosic sheet contains at least 35% magnesium oxide and at least 2.0% salt.

10. The wrapper of claim 1 in which the basis weight of the sheet is 50 g/m$^2$ or greater.

11. A smoking article comprising a tobacco charge and a wrapper for the tobacco charge, said wrapper comprising a combustible cellulosic sheet containing at least 15% magnesium oxide and at least 0.5% of a chemical adjuvant salt selected from the group consisting of the alkali metal acetates, carbonates, citrates, nitrates and tartrates, both percentages by weight based on the weight of the sheet, whereby upon burning the smoking article visible sidestream smoke is substantially reduced as compared to smoking articles of the same composition employing a conventional wrapper for the tobacco charge.

12. The smoking article of claim 11 in which the article is a cigarette and the sheet is used as an inner wrapper for the tobacco charge under an outer wrapper of conventional cigarette paper.

13. The smoking article of claim 11 in which the sheet contains at least 35% magnesium oxide and at least 2.0% salt.

14. The smoking article of claim 11 in which the salt is sodium or potassium acetate.

15. The smoking article of claim 11 in which the salt is sodium or potassium carbonate.

16. The smoking article of claim 11 in which the salt is sodium or potassium citrate.

17. The smoking article of claim 11 in which the salt is sodium or potassium nitrate.

18. The smoking article of claim 11 in which the salt is sodium or potassium tartrate.

19. A method for reducing the visible sidestream smoke emanated from a smoking article comprising wrapping the tobacco charge in the smoking article in the combustible cellulosic sheet containing at least 15% magnesium oxide and at least 0.5% of a chemical adjuvant salt selected from the group consisting of the alkali metal acetates, carbonates, citrates, nitrates and tartrates.

20. The method of claim 19 in which the basis weight of the sheet is 50 g/m$^2$ or greater.

* * * * *